United States Patent [19]

Kitai et al.

[11] 4,037,400

[45] July 26, 1977

[54] DRIVE DEVICE FOR ELECTRIC CLOCK

[75] Inventors: Kiyoshi Kitai, Tokyo; Masuo Ogihara, Chiba; Kozo Sato, Chiba; Nobuo Shinozaki, Chiba; Yoichi Seki, Shisui; Yuzuru Takazawa, Togane, all of Japan

[73] Assignee: Seiko Koki Kabushiki Kaisha, Japan

[21] Appl. No.: 674,303

[22] Filed: Apr. 6, 1976

[30] Foreign Application Priority Data

Apr. 7, 1975 Japan ..... 50-41970

[51] Int. Cl.[2] ..... G04B 19/30

[52] U.S. Cl. ..... 58/23 D; 310/46

[58] Field of Search ..... 58/23 R, 23 D, 85.5; 310/42, 43, 46, 257, 258, 152, 156

[56] References Cited

U.S. PATENT DOCUMENTS

| | | | |
|---|---|---|---|
| 3,376,442 | 4/1968 | David | 310/156 |
| 3,747,320 | 7/1973 | Vuffray | 58/23 D |
| 3,818,690 | 6/1974 | Schwarzschild | 58/23 D |
| 3,845,334 | 10/1974 | Harada et al. | 310/46 |
| 3,937,001 | 2/1976 | Berney | 58/23 D |
| 3,972,178 | 8/1976 | Beguin | 58/85.5 |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A polarized drive rotor having opposite polarity poles is rotatably arranged in the magnetic field developed by a coreless field coil and a polarized auxiliary rotor also having opposite polarity poles is arranged and magnetically coupled to the drive rotor so as to displace, the drive rotor through a preselected angle with respect to the direction of the magnetic field developed by the coreless field coil. An output is taken out of either one of the polarized rotors to drive a gear train and accordingly drive a clock hand. Electric drive circuitry applies a forward electric current to the field coil to rotationally advance the rotors and after the rotors stop and when a preselected time has passed since the energization of the coil, the rotors are rotated again in the same direction by applying a reverse electric current to the coil. In this way the clock hand can be driven stepwise at intervals of preselected constant time.

3 Claims, 11 Drawing Figures

DRIVE DEVICE FOR ELECTRIC CLOCK

BACKGROUND OF THE INVENTION

This invention relates to a drive device for use in an electric clock to drive the clock hand intermittently or stepwise at intervals of unit time.

In conventional electric clocks, it is a common practice to use a stepmotor or electromagnetic solenoid as a drive device to operate, for example, the second hand stepwise. However, stepmotors are generally complicated in structure and many of them use special input signals such as a two-phase signal. On the other hand, although the electromagnetic solenoids require only a simple input signal, they have a large power consumption and are not preferred for use in battery-operated electric clocks.

It is therefore an object of this invention to provide a drive device for an electric clock which is free from the disadvantages involved in the conventional drive devices, has a simple construction and can drive the clock hand stepwise with a reduced power consumption and by means of a simple input signal.

As is stated hereinabove, according to this invention, several rotors are driven stepwise in a simple manner by arranging the rotors at suitable positions and applying a next signal not during the driving period of the rotors but after the rotors having rotated through preselected angles and stopped. In this way a stepwise drive can be achieved at an inexpensive cost and with a reduced power consumption compared with the conventional methods.

BRIEF DESCRIPTION OF THE DRAWINGS:

Now the invention will be described in greater detail with reference to the accompanying drawings.

DETAILED DESCRIPTION OF INVENTION

Figure 2A:
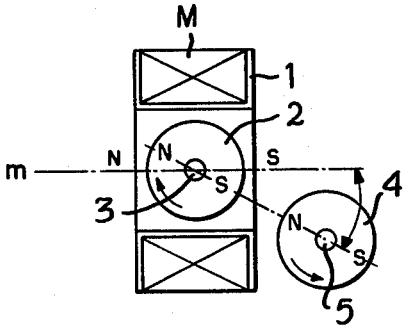
FIGS. 2*a* and 2*b* are views illustrating the structural principles of the drive portion wherein polarized rotors are arranged in parallel to each other.

In FIG. 2*a* a coreless field coil M is wound around a bobbin 1 so that upon application of an electric signal, an electric field is generated, the direction (*m*) to the center thereof being as shown in the drawing. A disc-type polarized drive rotor 2 having magnetic poles at the diametrically opposite positions thereof is arranged in the hollow area defined within the coreless field coil M. The rotor 2 is rotatable on the shaft 3. Similarly, a disc-type polarized auxiliary rotor 4 having magnetic poles at diametrically opposite positions is arranged in an inclined position, or at a suitable angle Q with respect to the central direction (*m*) of the electric field, in such a manner that it is rotatable on a shaft 5.

Figure 2B:
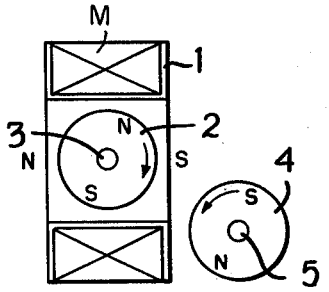

During the time when no electric signal is applied to the coreless field coil, the rotors are in a stabilized position with their magnetic poles opposed to each other as shown in FIG. 2*a* of the drawings. When an electric signal is applied to the coreless field coil M and a magnetic field is developed as shown in the drawings, the S- and N-poles of the polarized drive rotor 2 are repelled by the S- and N-poles of the coil M and develop a clockwise torque as shown by the arrow. Because of the magnetic attraction and repulsion with the polarized drive rotor 2, a counter-clockwise torque is imparted to the polarized auxiliary rotor 4. FIG. 2*b* is a view illustrating the intermediate state wherein the S- and N-poles of the polarized drive rotor 2 are attracted by the N- and S-poles so as to further increase the clockwise torque of the polarized drive rotor 2. At the same time the polarized auxiliary rotor 4 has imparted thereto a counter-clockwise torque. When the state of FIG. 2*b* is over, then the attracting force between the N-pole of the polarized drive rotor 2 and the S-pole of the polarized auxiliary rotor 4 promotes the rotors rotating until they stop in the position which is the reverse of that shown in FIG. 2*a*. In this reverse position the rotors are in a stabilized state with their poles being rotated for 180° from the starting position. Under these conditions if an electric signal having an opposite polarity to the first-applied electric signal is applied to the coreless field coil M, each rotor will rotate in the same direction for another 180° and stop.

In an embodiment of FIG. 2, each rotor is magnetized so as to have two opposite poles and will rotate for 180° each time an electric signal is applied. If the period beginning at the time when each rotor starts rotating and ending at the time when it stops in a stabilized position after having rotated for 180° is called the driving period of the rotor, then the driving period of the rotor will vary from several milliseconds to more than 100 milliseconds depending on the magnetic force of the rotors, the relative position between the rotors and the magnitude of the input signals. If the interval between the application of one electric signal and of the next electric signal is selected to be longer than the driving period of the rotors, then the rotors will have a rest period. Therefore, if an input signal is applied to the rotors during their rest period, then the rotors may be driven intermittently. When it is desired to intermittently move the second hand of the electric clock, this may be achieved by setting the driving period of the rotor to approx. 10–30 millisecond.

Figure 1:
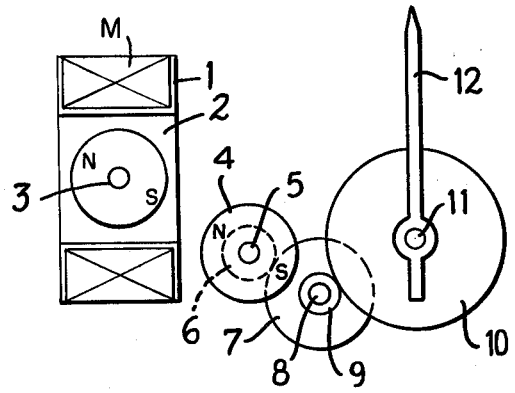
FIG. 1 is a schematic view for explaining the principles of the electric clock drive device according to this invention.

FIG. 1 illustrates an embodiment wherein the above-described principle is applied to an electric clock. In this drawing like numerals and letters indicate like parts and portions shown in FIG. 2. According to this embodiment, an output is taken from the polarized auxiliary rotor 4. Indicated at 6 is a pinion arranged coaxially with the polarized auxiliary rotor 4. Indicated at 7 is a gear meshed with a second pinion 6. A third pinion 9 is arranged coaxially with the gear 7 and meshed with a second hand gear 10. Indicated at 12 is a second hand of the electric clock which is driven together with the second hand. Indicated at 11 is a shaft for the second hand 12 and 8 is a common shaft for the gear 7 and pinion 9. In the drawing, the minute hand gear and hour hand gear are omitted for the sake of clarity.

Now the operation of the foregoing arrangement will be described. As stated previously, when electric signals having opposite polarities are applied at one second intervals, the polarized drive rotor 2 and polarized auxiliary rotor 4 will rotate stepwise for 180° at each time while providing in between a rest period as mentioned previously. As a result, the second hand 12 of the electric clock is driven stepwise together with the second hand gear 10 at each unit time of the input by way of the output transmission mechanism consisting of said pinions and gears.

Figure 4A:
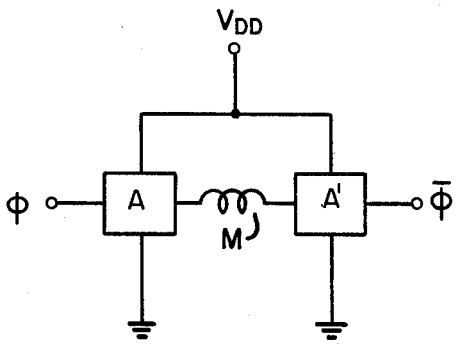
FIGS. 4*b*, 5*b* and 6*b* illustrate drive input signals for the schematic circuits shown in FIGS. 4*a*, 5*a* and 6*a*.
Figure 4B:
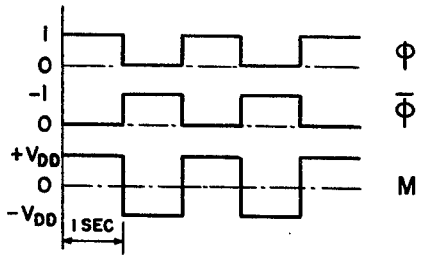

FIG. 4*a* is a schematic circuit diagram and FIG. 4*b* is a chart of electric signals for driving the circuit of FIG. 4*a*. Indicated at A and A′ are drive circuits for the coreless field coil M, the input signals to these drive circuits A and A′ being indicated at $\phi$ and $\overline{\phi}$. In FIG. 4*b* the presence and absence of the input signals $\phi$ and $\overline{\phi}$ are shown by 1 and 0. At the time when $\phi$ and $\overline{\phi}$ are 1 and 0, respectively, an electric current flows from power source $V_{DD}$ to drive circuit A′, coreless field coil M, drive circuit A and to the ground. Whereas, when $\phi$ and $\overline{\phi}$ are changed to 0 and 1, respectively, the electric current flows from power source $V_{DD}$ to drive circuit A, coreless field coil M, drive circuit A′ and to the ground. If these signals $\phi$ and $\overline{\phi}$ are changed at each second, for example, then an electric current having opposite polarities will be applied at each second to the coreless field coil M as shown in FIG. 4*b* at M. Consequently, the rotors will rotate stepwise.

In a large-sized electric clock, the clock hands will have correspondingly larger sizes and hence it is inevitable to increase the output from the drive device. In the drive device of this invention, the strength of the magnetic bond between the polarized drive rotor 2 and polarized auxiliary rotor 4 determines the output torque and therefore the output torque may be increased by increasing the magnetic bond. To increase the magnetic bond, a drive circuit of FIG. 5 may be employed which is obtained by the addition of a capacitor C to the circuit of FIG. 4.

Figure 5A:
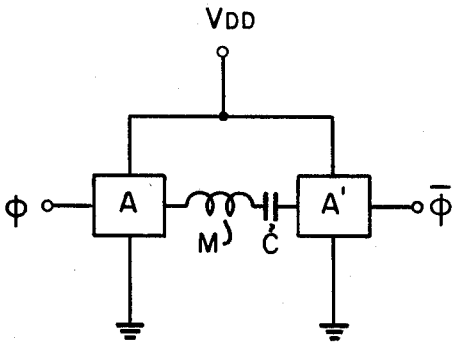
Figure 5B:
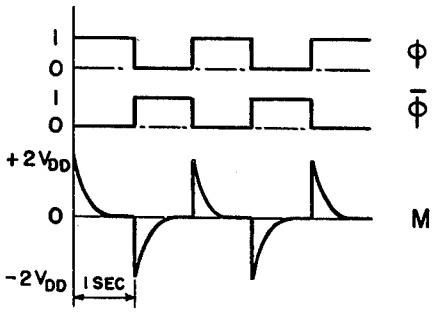

During operation of the drive circuit of FIG. 5, two separate electrical passage (power source $V_{DD}$ — drive circuit A′ — capacitor C — coreless field coil M — drive circuit A — ground and power source $V_{DD}$ — coreless field coil M — capacitor C — drive circuit A′ — ground) are established alternately at intervals of unit time. At this time since the capacitor C and coreless field coil M are connected in series to each other, an exciting current flows through the coreless field coil M from drive circuit A′ to drive circuit A. Consequently, the capacitor C is charged with the exciting current and, after the lapse of a preselected constant time when the exciting current is allowed to flow from drive circuit A to another drive circuit A′ upon application of the next signal, the voltage previously charged in the capacitor will be added. Thus the voltage (or current) to be applied to said coreless field coil M will become approximately $2 \times V_{DD}$ wo that the device is driven with an increased magnetic bond. The signal to be applied to the coil M, however, is that shown in FIG. 5*b* at M. The capacity of the capacitor C may be selected suitably depending on the power consumption and the states of the polarized drive rotor 2 and polarized auxiliary rotor 4.

Figure 6A:
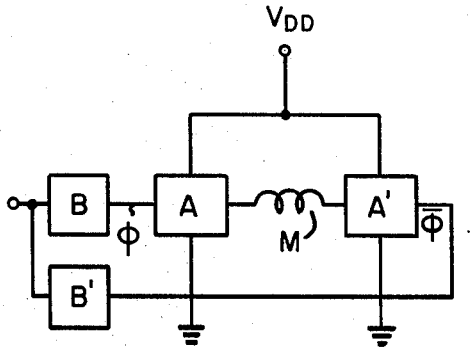
Figure 6B:
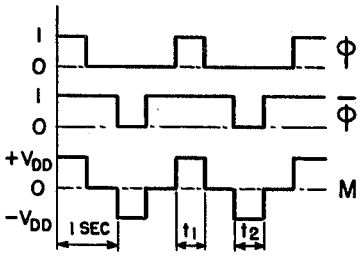

The signal as shown in FIG. 6*b* is a rectangular pulse signal similar to that of FIG. 4*b* and may be employed effectively when no power can be supplied for a unit period of time (e. g. 1 sec) because of the correlation with the power consumption. Indicated at A and A′ of FIG. 6*a* are drive circuits similar to those as shown in FIG. 4*a*; whereas B and B′ indicate timer circuits in the form of, for example, one-shot multivibrators which regulate the driving time of the drive circuits A and A′.

It is possible to minimize the power consumption by suitably selecting the times $t_1$ and $t_2$ of said timer circuits B and B′ taking the aforementioned driving period and rest period of the rotors into consideration.

It is also possible to operate the drive devices of this invention with other electric signals such as, for example, curviform pulses or triangular pulses. In other words, according to this invention there is no specific limitation to the waveform of the input signals applied to the coreless field coil, but either the first signal is kept applied until the rotors have rotated through the preselected angles and stabilized at their stop positions or the first signal is shut off and then the next signal is applied.

Figure 3A:
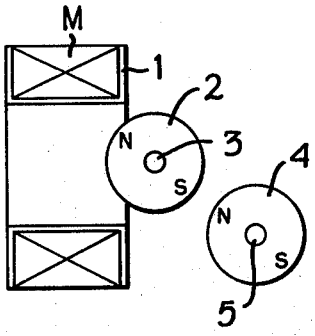
FIGS. 3*a* and 3*b* are similar views to FIGS. 2*a* and 2*b* but showing another embodiment and in the arrangement of FIG. 3*a*, outputs are taken out of the two rotors; whereas in the arrangement of FIG. 3*b* the two polarized rotors are disposed so that the axes of their shafts intersect each other at right angles.
Figure 3B:
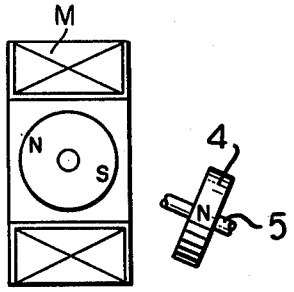

The arrangement of FIG. 3*a* is similar to that of FIG. 2*a* except that the drive rotor 2 is arranged outside of the hollow area defined in the coreless field coil M to thereby permit the output to be taken out of both the polarized drive rotor 2 and polarized auxiliary rotor 4. In the arrangement of FIG. 3*b* the rotors are not disposed parallel to each other but disposed so that the axes of their shafts intersect each other at right angles, thereby enabling diversity of the design of the electric clock.

Although the invention has been described with respect to the embodiments wherein the second hand is moved stepwise at each second, it will be apparent to those skilled in the art that the invention can be applied to the other portions of an electric clock such as hour hand, minute hand or calender mechanism. Furthermore, it will be apparent that the device of this invention may be applied easily to a stop watch which indicates fractions of one second. The angle of rotation for one step movement is not limited to 180° but any other angular step movement may be effected by use of rotors carrying more than two magnetic poles. In addition rotors are not limited only to a disc-type but rotors having projected poles may be employed for the purpose of this invention.

What is claimed is:

1. A drive device for driving a clock hand of an electric clock comprising: a polarized drive rotor having opposite polarity poles rotatably arranged in the magnetic field developed by a coreless field coil; a polarized auxiliary rotor having opposite polarity poles rotatably arranged and magnetically coupled to said polarized drive rotor so as to displace the polarized drive rotor through a suitable angle with respect to the central direction of the magnetic field developed by the coreless field coil whereby an output may be taken out of either one of said polarized drive rotor and polarized auxiliary rotor so as to drive the clock hand; and means for alternately applying an exciting current of opposite polarities to said coreless field coil to drive said polarized drive rotor and thereby drive said polarized auxiliary rotor due to the magnetic coupling between said two rotors to thereby move the clock hand at stepwise intervals.

2. A drive device according to claim 1, wherein the exciting current has a rectangular waveform.

3. A drive device according to claim 1, wherein a capacitor is connected in series to the coreless field coil, and wherein the exciting current comprises a differential exciting current.

* * * * *